US005558132A

United States Patent [19]

Haeussler et al.

[11] Patent Number: 5,558,132

[45] Date of Patent: Sep. 24, 1996

[54] ADJUSTABLE WARP TENSION ROLL SUPPORT IN A WEAVING LOOM

[75] Inventors: Horst Haeussler; Wilhelm Herrlein, both of Lindau/B, Germany

[73] Assignee: Lindauer Dornier Gesellschaft mbH, Lindau, Germany

[21] Appl. No.: 506,219

[22] Filed: Jul. 24, 1995

[30] Foreign Application Priority Data

Jul. 30, 1994 [DE] Germany ..... 44 27 126.3

[51] Int. Cl.[6] ..... D03D 49/12

[52] U.S. Cl. ..... 139/115

[58] Field of Search ..... 139/114, 115

[56] References Cited

U.S. PATENT DOCUMENTS

| | | | |
|---|---|---|---|
| 4,193,428 | 3/1980 | Demuth | 139/114 |
| 4,256,147 | 3/1981 | Deborde | 139/115 |
| 5,044,408 | 9/1991 | Vandeweghe et al. | 139/115 |

FOREIGN PATENT DOCUMENTS

| | | | |
|---|---|---|---|
| 0109472 | 5/1984 | European Pat. Off. . | |
| 0396501 | 11/1990 | European Pat. Off. . | |
| 0409306 | 1/1991 | European Pat. Off. . | |
| 650888 | 3/1936 | Germany | 139/115 |
| 0082450 | 5/1984 | Japan | 139/114 |
| 0026849 | 6/1985 | Japan | 139/115 |

*Primary Examiner*—Andy Falik

*Attorney, Agent, or Firm*—W. G. Fasse; W. F. Fasse

[57] ABSTRACT

A warp tensioning mechanism for a weaving loom is so constructed that a crossbar (8) that carries the tensioning mechanism is mounted at each end in the loom frame for a three-dimensional adjustment (5, 5A, 5B) vertically up and down, horizontally back and forth, and angularly about the longitudinal axis of the crossbar. After adjustments have been made, the crossbar is locked in position. The crossbar carries two sets of bearing brackets. One set (16) of bearing brackets holds a carrier beam in first bearings. The carrier beam in turn holds a warp tensioning roller (23) in second bearings (18). The second set of carrier brackets (16A) holds a warp guide roller (25) in third bearings (27).

13 Claims, 3 Drawing Sheets

ADJUSTABLE WARP TENSION ROLL SUPPORT IN A WEAVING LOOM

CROSS-REFERENCE TO RELATED APPLICATIONS

The present application is related to our copending, commonly assigned application U.S. Ser. No. 08/506,217, filed on Jul. 24, 1995. The disclosure of the related application is incorporated herein by reference.

FIELD OF THE INVENTION

The invention relates to an apparatus for tensioning the warp threads in a weaving loom with a constant biasing force. In this disclosure the warp threads will be referred to simply as the "warp".

BACKGROUND INFORMATION

European Patent Publication EP 0,109,472 A1 (Pfarrwaller) published Mar. 30, 1984 discloses an apparatus for tensioning the warp threads in a loom. The purpose of such tensioning apparatus is to present the warp with a substantial warp tension to the shed forming elements of the loom. The warp tension must remain at a certain level during the entire withdrawal of the warp from the warp beam. Further, the inertia of the tensioning elements must be as small as possible to assure that periodic oscillation of the warp tensioning element are performed with the required rapidity. The above European Patent Publication 0,109,472 discloses a tensioning rod biased by a spring and supported by a support beam on which the tensioning rod is supported by several supports distributed along the weaving width. Additionally, the support beam and the tensioning rod are tiltably mounted for tilting about the longitudinal axis of the support beam. The tensioning rod itself is of rigid construction and is not supposed to have an inherent spring characteristic. If the support beam itself is tiltably mounted in the loom frame, the tensioning rod may be rigidly secured to the support beam. The support beam of the tensioning rod and a warp guide beam are mounted in a plurality of bearing plates positioned below the weaving plane and supported in the loom frame so that the support beam and the warp guide beam are positioned between the warp beam and the tensioning rod.

The just described conventional mounting of the support beam of the tensioning rod, and of the warp guide beam makes it possible that these elements can be constructed with relatively small cross sectional dimensions so that these elements have a relatively small mass. However it is a disadvantage that the tensioning rod must necessarily be rigidly connected to the support beam by respective connecting elements. Such a construction is not cost efficient in view of the manufacturing steps needed for the rigid connecting elements between the support beam and the tensioning rod.

Another conventional warp tensioning device is disclosed in European Patent Publication EP 0,409,306 A1 (Vandeweghe et al.) published Jul. 17, 1989, wherein the tensioning device is constructed for periodically influencing the warp tension in response to the warp tension that occurs during the beat up and corresponding shed change. For this purpose the backrest in the tensioning device of European Patent Publication EP 0,409,306 A1 is mounted in the loom frame on two supports which in turn are mounted on respective carrier arms positioned below and parallel to the weaving plane. Each carrier arm is in turn articulated with one end to a second arm which is tiltably mounted. The other end of the carrier arm is operatively connected with a camshaft driven by a gear drive. The cam stroke makes it possible to periodically tension and to slacken the warp. The just described tensioning device leaves room for improvement, especially with regard to reducing the mass of the entire warp tensioning unit including the warp tensioning roller and the warp guide roller.

OBJECTS OF THE INVENTION

In view of the above it is the aim of the invention to achieve the following objects singly or in combination:

- to provide a tensioning device for the warp in a loom which avoids mounting a warp tensioning roller directly and rigidly on a carrier beam;
- to mount the warp tensioning roller in such a manner that the warp tension can be controlled independently of the mounting of a warp guide roller;
- to provide a substantially constant warp tension with the help of lightweight structural components;
- to provide one set of carrier brackets for supporting a warp guide roller and another, different set of carrier brackets for carrying a support beam, which in turn supports the warp tensioning roller in a rotatable manner; and
- to provide for a horizontal, vertical, and angular adjustment of the position of the warp tensioning device.

SUMMARY OF THE INVENTION

The present warp tensioning mechanism combines according to the invention the following features in a weaving loom. A loom frame includes a first outer or lateral upright frame member on one side of the loom and a respective mirror-symmetrical second upright frame member on the opposite side of the loom. A warp tensioning roller, a carrier beam for the warp tensioning roller and a warp guide roller extend across the weaving width of the loom. The carrier beam is connected to a biasing device for biasing the warp tensioning roller loosely carried by the carrier beam, into a warp tensioning position for applying a constant tensioning force to the warp. A crossbar extends across the weaving width and carries a plurality of carrier brackets divided into two sets or groups. One group of carrier brackets is constructed to support through the carrier beam the warp tensioning roller in a floating or loose rotatable manner. The other set of carrier brackets is constructed to floatingly support the warp guide roller. By "floating support" is meant that the warp guide roller and the warp tensioning roller rest loosely in respective bearings in which the rollers are held by gravity and by the warp tension for an easy exchange of one set of rollers against another set of rollers. The crossbar is mounted at each of its ends through two mounting members to the respective upright loom frame member. One of the mounting members is constructed to permit a vertical up and down position adjustment of the crossbar and all components supported by the crossbar. The other mounting member permits on the one hand a horizontal back and forth position adjustment and an angular position adjustment of the crossbar when a clamp seat in which the ends of the crossbar are held, are loosened for the angular adjustment and then tightened again. Thus, the crossbar and the components supported thereby are adjustable in the three directions of space vertically up and down, horizontally back and forth, and angularly for an effective warp tensioning. First bearings preferably at the free ends of one set of carrier brackets hold the carrier beam, which in turn carries second bearings for the warp tensioning roller. The second set of carrier brackets provides third bearings for the warp guide roller.

The second bearings for the warp tensioning roller and the third bearings for the warp guide roller are preferably constructed as bearing rollers providing two points of support. This type of bearings permits a further reduction in the diameter of the warp tensioning roller, of the carrier beam, and of the warp guide roller. In addition to the constant warp tension achieved according to the invention, the present tensioning mechanism avoids relative movement between the warp threads and the warp guide roller and also between the warp threads and the warp tensioning roller, whereby the warp threads are protected. Moreover, if desired, one set of a warp tensioning roller and a warp guide roller is easily exchanged against another set of such rollers, particularly when the bearings are formed by bearing rollers rather than as slide bearings.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figures 2, 2A:
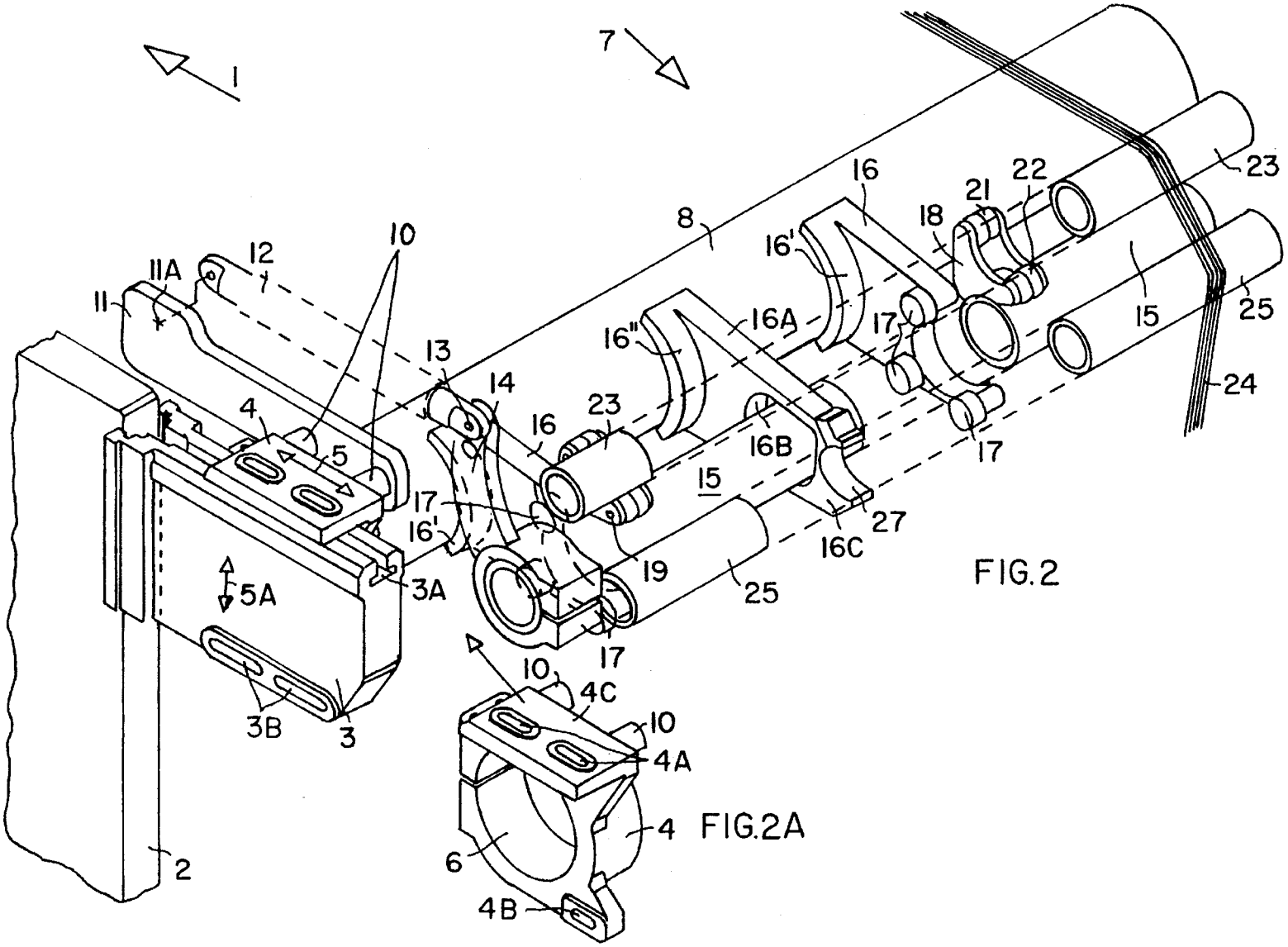
FIG. 2 is a perspective view of one end portion of the mechanism shown in FIG. 1.
FIG. 2A shows a mounting for a crossbar of the present warp tensioning mechanism.

Referring to the Figures in conjunction, the view direction 1 corresponds to the travel direction of the warp. FIG. 2 thus shows the left side of the loom from the viewer's point of view. The loom frame comprises upright frame members 2 and the present mechanism comprises a mounting member 3 mounted to the respective frame member 2 and a second mounting member 4 connected to the first mounting member 3 on each side of the loom. The components 2, 3 and 4 are also provided mirror-symmetrically on the right hand side of the loom. Only the left side of the loom is shown in the drawings.

The mounting member 3 is secured to the upright frame member 2 for a vertical up and down adjustment as indicated by the double arrow 5A. The mounting member 4 shown in more detail in FIG. 2A is secured with its slide section 4C to the top guide rail 3A of the mounting member 3 for a horizontal back and forth adjustment movement as indicated by the arrow 5. Once the mounting member 4 is adjusted to the desired position along the mounting member 3, clamping screws not shown passing through the elongated holes 4A and into the groove of the guide rail 3A are tightened. Similarly, a bolt passing through an elongated hole 4B and through the holes 3B is tightened once the linear adjustments have been made. As shown in FIG. 2A the second mounting member 4 forms a clamp seat 6, in which one end of a crossbar 8 is mounted on each side of the loom. The crossbar 8 is angularly adjustable about its longitudinal axis 8A as indicated by the arrow 5B in FIGS. 1 and 3. For this purpose, the mounting member 4 has a s lot 4D so that the body of the member 4 can act as a clamp with the help of a threaded bolt 9 passing perpendicularly through the slot 4D in the body of the member 4. When the bolt 9 is loosened the crossbar 8 and all components rigidly attached thereto can be angularly adjusted. Once the adjustment has been made, the bolt 9 is tightened again.

The second mounting member 4 is equipped with studs 10 carrying an arm 11 for supporting one end of a warp tension biasing spring 12 which is pivoted to the arm 11 at 11A. The other end of the biasing spring 12 is pivoted to a lever 14 at a pivot 13. The lower end of the lever 14 is rigidly, but releasably connected to a carrier beam 15 for a warp tensioning roller 23 by a clamp member 14A. The carrier beam 15 extends across the loom weaving width.

According to the invention, two sets of different carrier brackets 16 and 16A are secured to the crossbar 8. For this purpose the carrier brackets 16 and 16A have mounted ends with curved flanges 16' and 16" respectively, which rest against the surface of the crossbar 8 and are secured thereto, for example, by screws S shown symbolically in FIGS. 1 and 3. Each set of carrier brackets 16 and 16A comprises at least two brackets, namely two brackets 16 and two brackets 16A arranged near the sides of the loom.

However, it is preferable to provide a plurality of brackets in each set so that these brackets may be arranged in alternate fashion across the weaving width. FIG. 2 shows a first bracket 16 near the lever 14, then a bracket 16A spaced from the first bracket, and then again a bracket 16 spaced from the second bracket etc. All brackets of the tensioning mechanism are axially aligned relative to each other for floatingly or loosely supporting a warp tensioning roller 23 with one set of brackets 16 and a warp guide roller 25 with the other set of brackets 16A as will now be described.

Figure 1:
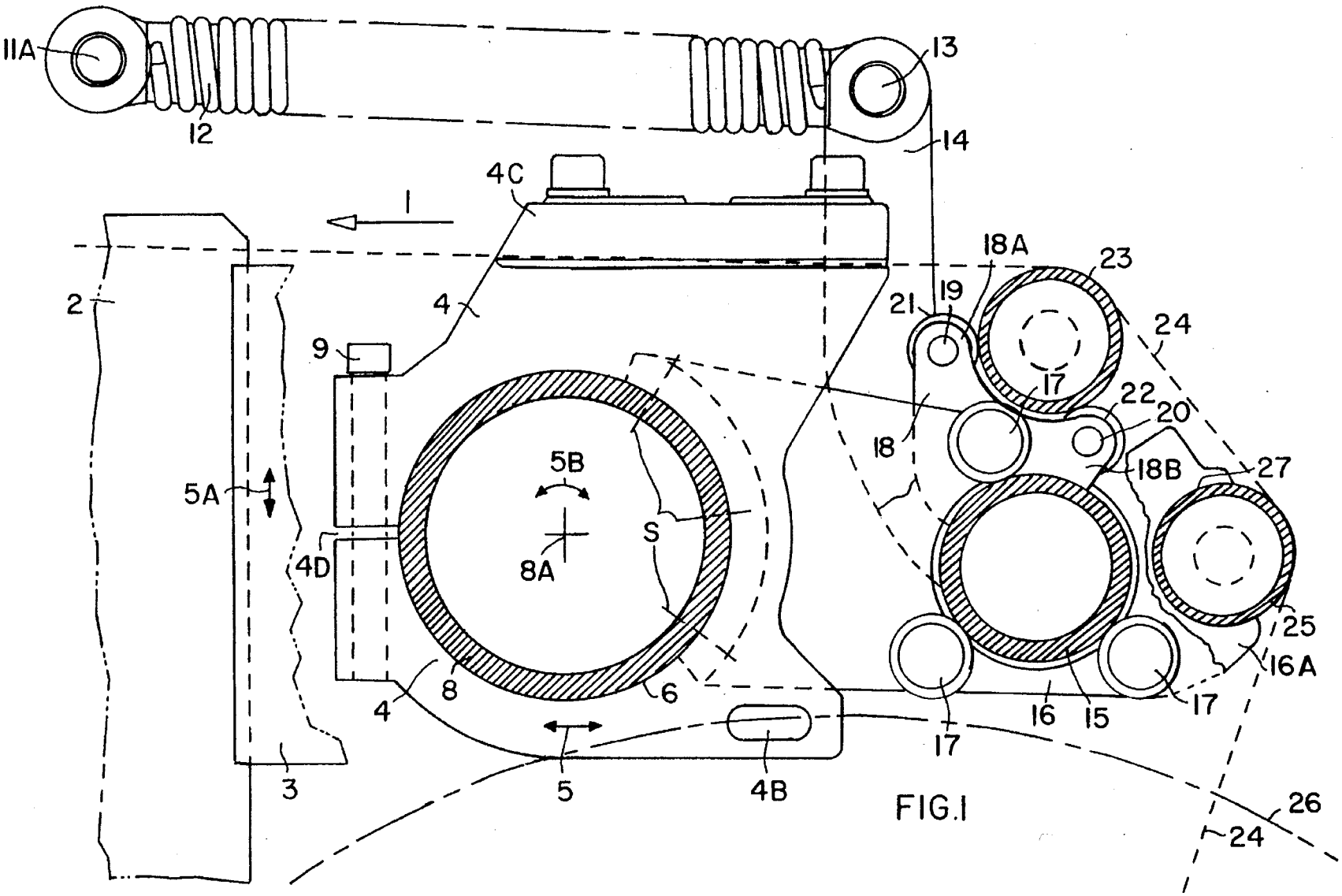
FIG. 1 is an axial view partly in section of a first embodiment of the warp tensioning mechanism according to the invention with a warp guide roller rotatably held in a slide saddle bearing and a warp tensioning roller supported by bearing rollers forming two-point saddle bearings supported on a carrier beam.
Figure 3:
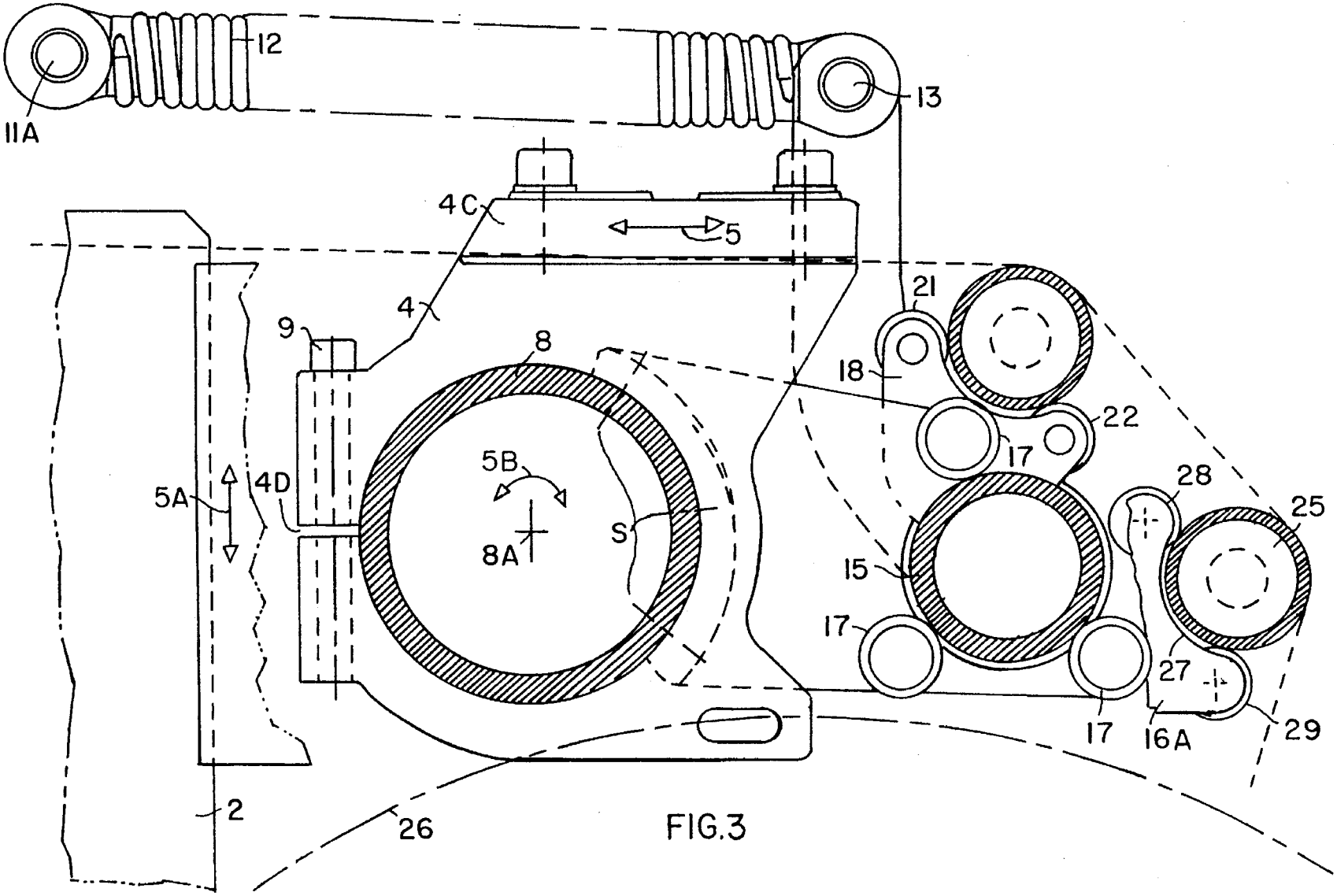
FIG. 3 is a view similar to that of FIG. 1, however illustrating first, second and third bearings each comprising at least two bearing rollers to provide respective saddle bearings for the carrier beam, for the warp tensioning roller, and for the warp guide roller.

The brackets 16 comprise at their free end a first bearing, preferably including at least two, more preferably three, bearing rollers 17 for floatingly holding the carrier beam 15. Second bearings 18 are rigidly secured to the carrier beam each to provide a bearing surface formed preferably by bearing rollers 21 and 22 for floatingly holding the warp tensioning roller 23 for the warp 24, which is taken off a warp beam 26, shown by a dashed line in FIGS. 1 and 3. A third bearing 27 for the warp guide roller 25 is formed at the free end of each of the second carrier brackets 16A. The bearing 27 is for example a slide bearing, as shown in FIG. 1 or it may be a bearing with preferably two bearing rollers 28 and 29 as shown in FIG. 3. These rollers 28 and 29 form a so-called two-point roller bearing also referred to as saddle bearing.

Referring to FIG. 1, the second bearing 18 comprises a bearing bracket with two arms 18A and 18B. The first arm 18A holds a journal 19 for a bearing roller 21. The second arm 18B holds a journal 20 for a bearing roller 22. All second bearings 18 are axially aligned with each other and also form two-point roller bearings for the warp tensioning roller 23. The arms 18A and 18B have different length as seen in FIG. 1. Depending on the biasing force of the spring 12, the lever 14 will rotate the carrier beam 15 either clockwise or counterclockwise. When the biasing lever 14 and with it the carrier beam 15 rotate counterclockwise the arm 18B will be lifted and the arm 18A will be lowered resulting in a raising of the warp tensioning roller 23. The opposite takes place when the lever 14 is rotated clockwise, whereby the roller 23 is somewhat lowered. In both instances the warp tensioning roller 23 is held in place by gravity and by the warp 24.

The warp guide roller 25 is positioned between the warp tensioning roller 23 and the warp beam 26, whereby the aligned bearings 27 on the separate carrier brackets 16A in cooperation with the warp 24 hold the warp guide roller 25 in place. The biasing lever 14 with its spring 12 is preferably also provided at each end or rather at each side of the loom, so that a symmetrical force distribution with regard to the support beam 15 is achieved. The train of force transmission is thus from the biasing spring 12, which is preferably a tension spring, through the lever 14, the carrier beam 15, the support bearing 18, the warp tensioning roller 23 to the warp 24. This construction of the present tensioning mechanism 7 thus assures that a constant warp tension is maintained throughout a weaving operation, uniformly for all warp threads over the entire weaving width.

As best seen in FIGS. 1 and 3, the components 8, 15, 23 and 25 are preferably hollow tubular members with the advantage that a lightweight construction is possible, because especially the components 15, 23 and 25 are repeatedly supported along their length across the weaving width. In this context it should be noted that the brackets 16 hold the carrier beam 15 in the first bearings 17 independently of the brackets 16A. For this purpose the brackets 16A have through holes 16B through which the carrier beam 15 extends with sufficient play. Similarly, the brackets 16A support the warp guide roller 25 independently of the brackets 16. Thus, due to the connection of the biasing spring 12 through the lever 14 to the carrier beam 15, the warp tensioning roller 23 is elastically supported by the second bearings 18 on the carrier beam. However, the warp guide roller 25 is rigidly but rotatably supported on the third bearing 27 of the second carrier brackets. Due to the rigid attachment of the brackets at their ends 16' and 16" to the crossbar 8, all components of the tensioning mechanism 7 participate in unison in the above described adjustments 5, 5A and 5B.

Although the invention has been described with reference to specific example embodiments, it will be appreciated that it is intended to cover all modifications and equivalents within the scope of the appended claims.

What is claimed is:

1. A warp tensioning mechanism for a weaving loom having a weaving width, comprising a loom frame, a lateral upright frame member (2) on each side of said loom frame, a warp tensioning roller (23), a warp guide roller (25), and a carrier beam (15) extending across said weaving width, a first mounting member (3) operatively connected to a respective upright frame member (2) on each side of said loom frame for a vertical up and down adjustment (5A), a second mounting member (4) operatively connected to said first mounting member (3) for a horizontal back and forth adjustment (5), said second mounting member (4) comprising a clamp seat (6), a crossbar (8) extending across said weaving width and having each end mounted in said clamp seat (6) on each side of said loom frame for an angular adjustment (5B) around a longitudinal axis (8A) of said crossbar (8) when said clamp seat (6) is loosened, a first set of carrier brackets (16) each having a mounted end (16') rigidly secured to said crossbar (8) and a first free end including a first bearing (17) for rotatably holding said carrier beam (15), a bearing bracket (18) secured to said carrier beam (15), said bearing bracket (18) comprising a second bearing (21, 22) for rotatably supporting said warp tensioning roller (23), a biasing device (12, 14) connected to said carrier beam (15) for biasing said warp tensioning roller (23) into a warp tensioning position, a second set of carrier brackets (16A) each having a mounted end (16") rigidly secured to said crossbar (8) and a second free end including a third bearing (27) for rotatably holding said warp guide roller (25).

2. The warp tensioning mechanism of claim 1, wherein said first bearing (17) for rotatably holding said carrier beam (15) comprises three first bearing rollers (17) forming a three-point bearing roller support for said carrier beam (15).

3. The warp tensioning mechanism of claim 1, wherein said second bearing of said bearing bracket (18) comprises second bearing rollers (21, 22) for rotatably supporting said warp tensioning roller (23), and wherein said third bearing (27) comprises third bearing rollers (28, 29) for rotatably supporting said warp guide roller (25).

4. The warp tensioning mechanism of claim 3, wherein said second bearing rollers comprise a pair of bearing rollers (21 and 22) forming a two-point bearing roller support for said warp tensioning roller (23), and wherein said third bearing rollers comprise a further pair of bearing rollers (28, 29) forming a further two-point bearing roller support for said warp guide roller (25).

5. The warp tensioning mechanism of claim 1, wherein said third bearing (27) is a slide bearing formed as a slide seat at said free end of said second set of carrier brackets (16A) for rotatably holding said warp guide roller (25).

6. The warp tensioning roller of claim 1, wherein said biasing device comprises a lever (14) rigidly connected to said carrier beam (15) and a biasing spring (12) connected to said lever (14) and to said loom frame.

7. The warp tensioning mechanism of claim 1, wherein each of said crossbar (8), said carrier beam (15), said warp tensioning roller (23), and said warp guide roller (25) are hollow tubular members.

8. The warp tensioning mechanism of claim 1, wherein said second mounting member (4) comprises a clamp body, a circular through bore forming said clamp seat (6) in said clamp body, a lateral slot (4D) in said clamp body reaching to said through bore, a threaded bolt (9) extending crosswise to said slot (4D) whereby loosening said threaded bolt permits said angular adjustment (5B) of said crossbar (8) mounted in said clamp seat (6) and tightening of said threaded bolt permits rigidly locking said crossbar (8) in an angularly adjusted fixed position, said clamp body further comprising a slide section (4C) for slidingly engaging said first mounting member (3), and connecting elements (4A, 4B, 3A, 3B) for rigidly securing said clamp body (4) to said first mounting member (3) in a horizontally adjusted position.

9. The warp tensioning mechanism of claim 1, wherein each of said second carrier brackets (16A) comprises an axially facing through hole (16B) through which said carrier beam (15) extends with play.

10. The warp tensioning mechanism of claim 1, wherein said mounted ends (16', 16") of said first set (16) and of said second set (16A) of carrier brackets have a curved flange resting against said crossbar (8) and secured thereto by screws (S) so that an angular position adjustment of said crossbar (8) provides an angular position adjustment of said carrier brackets (16, 16A).

11. The warp tensioning mechanism of claim 1, wherein said carrier brackets (16) of said first set alternate with said carrier brackets (16A) of said second set along said carrier beam (15).

12. The warp tensioning mechanism of claim 1, wherein said first set of carrier brackets (16) hold said carrier beam (15) and said warp tensioning roller (23), wherein said second set of carrier brackets (16A) hold said warp guide roller (25) so that said warp guide roller (25) is rotatably but rigidly held by said second set of carrier brackets (16A), and wherein said biasing device (12, 14) is connected only to said support beam (15) so that said warp tensioning roller (23) is biased elastically and independently of said warp guide roller (25).

13. The warp tensioning mechanism of claim 12, wherein each carrier bracket (16A) of said second set of carrier brackets comprises a through hole (16B) through which said carrier beam (15) extends with play, whereby said first set of carrier brackets (16A) hold said carrier beam (15) and said warp tensioning roller (23) independently of said second set of carrier brackets (16A).

* * * * *